US009228288B2

(12) United States Patent
Davis et al.

(10) Patent No.: US 9,228,288 B2
(45) Date of Patent: Jan. 5, 2016

(54) PRETREATMENT CUP

(75) Inventors: William John Davis, Bath (GB); David James McNeill, Bath (GB); Pieter Paul Dirk Jenny Maria Van Den Bergh, St. Martens (BE)

(73) Assignee: The Procter & Gamble Company, Cincinnati, OH (US)

( * ) Notice: Subject to any disclaimer, the term of this patent is extended or adjusted under 35 U.S.C. 154(b) by 798 days.

(21) Appl. No.: 13/477,597

(22) Filed: May 22, 2012

(65) Prior Publication Data

US 2012/0298543 A1 Nov. 29, 2012

(30) Foreign Application Priority Data

May 23, 2011 (EP) ..... 11167096

(51) Int. Cl.

| | |
|---|---|
| ***B65D 85/00*** | (2006.01) |
| ***D06F 39/02*** | (2006.01) |
| ***B65D 47/42*** | (2006.01) |
| ***B65D 51/32*** | (2006.01) |
| ***D06F 3/00*** | (2006.01) |
| ***B65D 41/26*** | (2006.01) |
| ***B65D 1/26*** | (2006.01) |
| ***B65D 81/38*** | (2006.01) |
| ***A46B 11/00*** | (2006.01) |

(52) U.S. Cl.

CPC ..... *D06F 39/024* (2013.01); *A46B 11/0013* (2013.01); *B65D 1/265* (2013.01); *B65D 41/26* (2013.01); *B65D 47/42* (2013.01); *B65D 51/32* (2013.01); *B65D 81/3869* (2013.01); *D06F 3/00* (2013.01)

(58) Field of Classification Search

USPC ..... 401/118, 126, 123, 129, 265, 195, 202, 401/263, 183

See application file for complete search history.

(56) References Cited

U.S. PATENT DOCUMENTS

| | | | |
|---|---|---|---|
| 3,090,067 | A | 5/1963 | Weiby et al. |
| 3,107,388 | A | 10/1963 | Groves |
| 4,741,459 | A | 5/1988 | Silvenis et al. |
| 4,767,034 | A | 8/1988 | Cramer |
| 5,181,630 | A | 1/1993 | McNally |
| 5,228,596 | A | 7/1993 | McNally |
| 5,251,788 | A | 10/1993 | Moore |
| 5,355,541 | A | 10/1994 | Rutter et al. |
| 5,388,298 | A | 2/1995 | Rutter et al. |

(Continued)

FOREIGN PATENT DOCUMENTS

| | | |
|---|---|---|
| DE | 200 04 275 U1 | 8/2000 |
| GB | 2 168 931 | 7/1986 |

(Continued)

OTHER PUBLICATIONS

European Search Report for Application Serial No. 11167096.4, mailed Jan. 27, 2012, 6 pages.

(Continued)

*Primary Examiner* — Paul R Durand
*Assistant Examiner* — Thomas M Abebe
(74) *Attorney, Agent, or Firm* — Gary J. Foose

(57) ABSTRACT

A pretreatment cup that encourages the customer to pretreat stained fabrics with a liquid laundry detergent composition, the pretreatment cup having a pretreatment region that is differentiated from other parts of the cup by a difference in material, color, translucency, surface texture, a line, and mixtures thereof.

18 Claims, 9 Drawing Sheets

(56) References Cited

U.S. PATENT DOCUMENTS

| | | | | |
|---|---|---|---|---|
| 5,549,209 | A | 8/1996 | Weissman et al. | |
| D382,482 | S | 8/1997 | Lathrop et al. | |
| 6,353,954 | B1 | 3/2002 | Dunsbergen et al. | |
| 6,739,781 | B2 * | 5/2004 | Maloney et al. | 401/266 |
| 6,874,190 | B2 | 4/2005 | Deflander et al. | |
| 7,425,102 | B1 | 9/2008 | Velliquette | |
| D689,364 | S | 9/2013 | Sanders | |
| 8,613,563 | B2 * | 12/2013 | Chawla et al. | 401/126 |
| 2003/0198502 | A1 | 10/2003 | Maloney et al. | |
| 2009/0014465 | A1 | 1/2009 | De Wree et al. | |
| 2009/0045224 | A1 | 2/2009 | Faaborg et al. | |
| 2011/0162151 | A1 | 7/2011 | Chawla et al. | |
| 2011/0179585 | A1 | 7/2011 | Chawla et al. | |
| 2011/0179586 | A1 | 7/2011 | Chawla et al. | |
| 2011/0179587 | A1 | 7/2011 | Chawla et al. | |
| 2011/0311296 | A1 | 12/2011 | Chawla et al. | |
| 2012/0297552 | A1 | 11/2012 | Davis et al. | |

FOREIGN PATENT DOCUMENTS

| | | | |
|---|---|---|---|
| GB | 2 349 649 | | 11/2000 |
| JP | 11-244770 | A | 9/1999 |
| WO | WO 98/16148 | A1 | 4/1998 |
| WO | WO 98/16438 | A1 | 4/1998 |
| WO | WO 00/20676 | A1 | 4/2000 |
| WO | WO 01/23295 | A2 | 4/2001 |
| WO | WO 02/16686 | A1 | 2/2002 |
| WO | WO 2004/112538 | A1 | 12/2004 |
| WO | WO 2008/135953 | A1 | 11/2008 |
| WO | WO 2010/012552 | A1 | 2/2010 |

OTHER PUBLICATIONS

Photographs of a dosing ball sold with a Henkel Persil Gold 1.5L bottle that was purchased in Sep. 2009.

* cited by examiner

PRETREATMENT CUP

FIELD OF THE INVENTION

The present invention relates to a pretreatment cup for encouraging pretreating of fabric stains with a liquid detergent composition.

BACKGROUND OF THE INVENTION

Many of today's liquid laundry detergent compositions are formulated to deliver superior removal of grease, soils, and other stains. However, many customers still prefer to use specialist pretreat compositions, even though liquid laundry detergent compositions are often formulated for pretreating stains.

A big cause for this customer behaviour is that dosing devices, typically sold with liquid laundry detergent compositions, are less than satisfactory for use in pretreating, except for on light and non-greasy stains. They are often also not intuitive to use, with many customers not even being aware that they can be used for effectively pretreating stains.

As a result, customers often either do not pretreat, or prefer to buy specialist pretreaters for removing stains, particularly for tough stains such as grease, ink, lipstick, and the like. This is regardless of the fact that many current liquid laundry detergent compositions contain surfactants, enzymes, soil release polymers and other stain removing actives. In addition, such liquid laundry detergent compositions are more effective in removing stains when applied neat, since the concentration of actives on the stain is much greater. Therefore, encouraging customers to pretreat results in better stain removal, and hence in customers being more satisfied with their liquid laundry detergent composition.

Therefore, a need remains for a pretreating device, wherein the customer is intuitively guided to use the pretreatment device for pretreating stains with a liquid laundry detergent composition. U.S. Pat. No. 5,549,209 discloses a closure for a liquid laundry detergent container having an integrated brush, U.S. Pat. No. 5,388,298 discloses a dispenser with an integrated scrubbing surface and pretreat nozzle, U.S. Pat. No. 4,767,034 discloses a cap to a spray bottle having an integrated scrubber. U.S. Pat. No. 6,874,190 discloses a hand-held container for washing laundry. U.S. Pat. No. 5,181,630 discloses a cap having a pouring spout. GB 2 168 931 discloses a cap having an applicator.

SUMMARY OF THE INVENTION

The present invention relates to a pretreatment cup (10) comprising: a base comprising an exterior base surface (50); a wall comprising an exterior wall surface (60); and an opening (40) circumscribed by a rim (170), wherein the opening is at least partially opposite the base; wherein: the exterior base surface (50) is connected to the exterior wall surface (60) at an exterior periphery (70); a surface selected from the group consisting of: the exterior base surface (50), the exterior wall surface (60), and mixtures thereof, comprises a pretreating region selected from the group consisting of: a spreading region (80), a scrubbing region (110), and mixtures thereof; characterized in that: the pretreating region is differentiated from at least part of the remaining combined area of the exterior base surface (50) and the exterior wall surface (60) by: a difference in material, colour, translucency, surface texture, a line, and mixtures thereof.

DETAILED DESCRIPTION OF THE INVENTION

Figure 1:
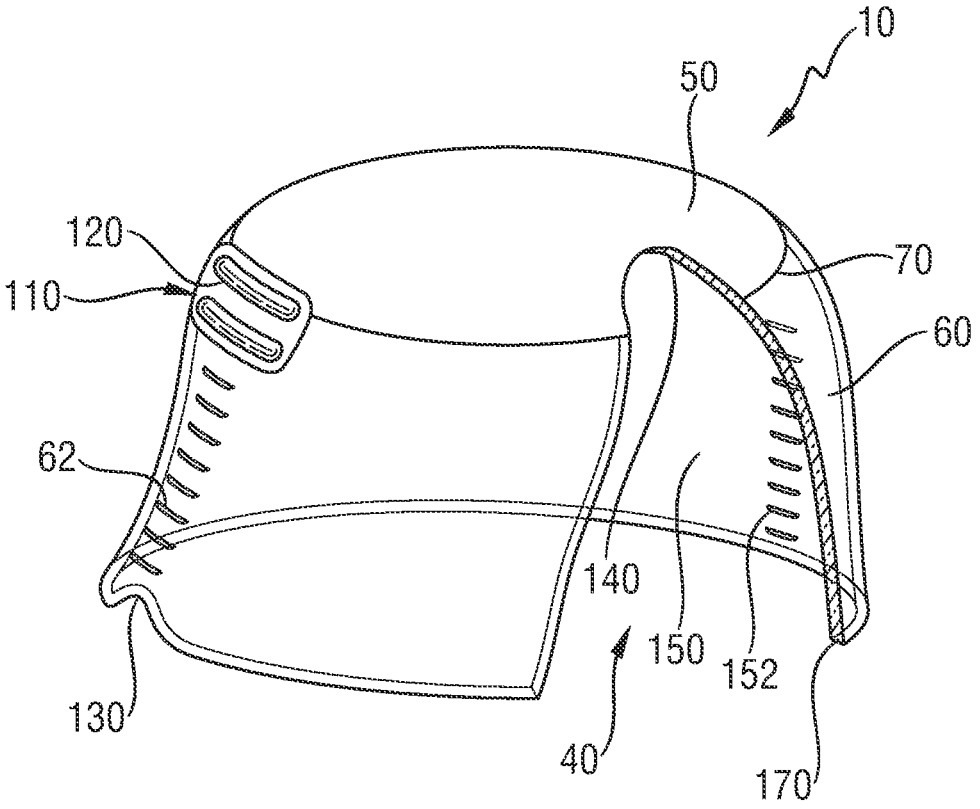
FIG. 1 illustrates a transparent pretreatment cup (10), comprising an opaque scrubbing region (110), with the exterior base surface (50) oriented towards the top.
Figure 2:
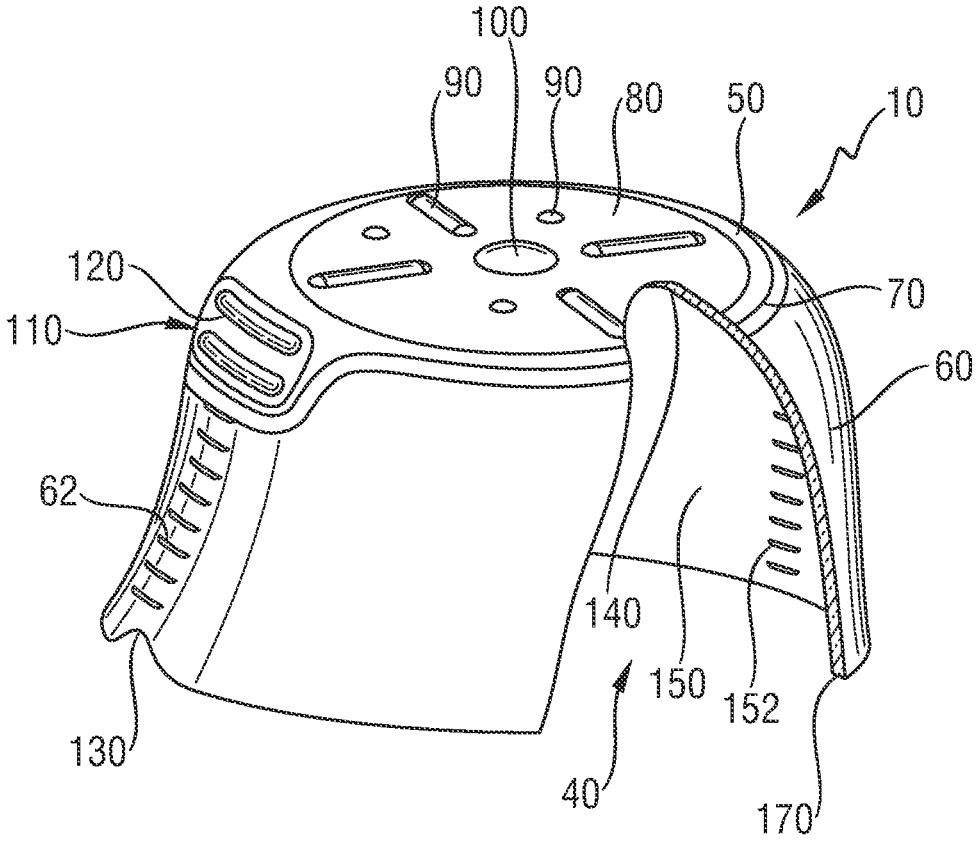
FIG. 2 illustrates an opaque pretreatment cup (10), comprising an opaque scrubbing region (110) and an opaque spreading region (80), with the scrubbing region (110) and spreading region (80) differentiated from the rest of the exterior wall surface (60) by a translucent region in the form of a line.
Figure 3:
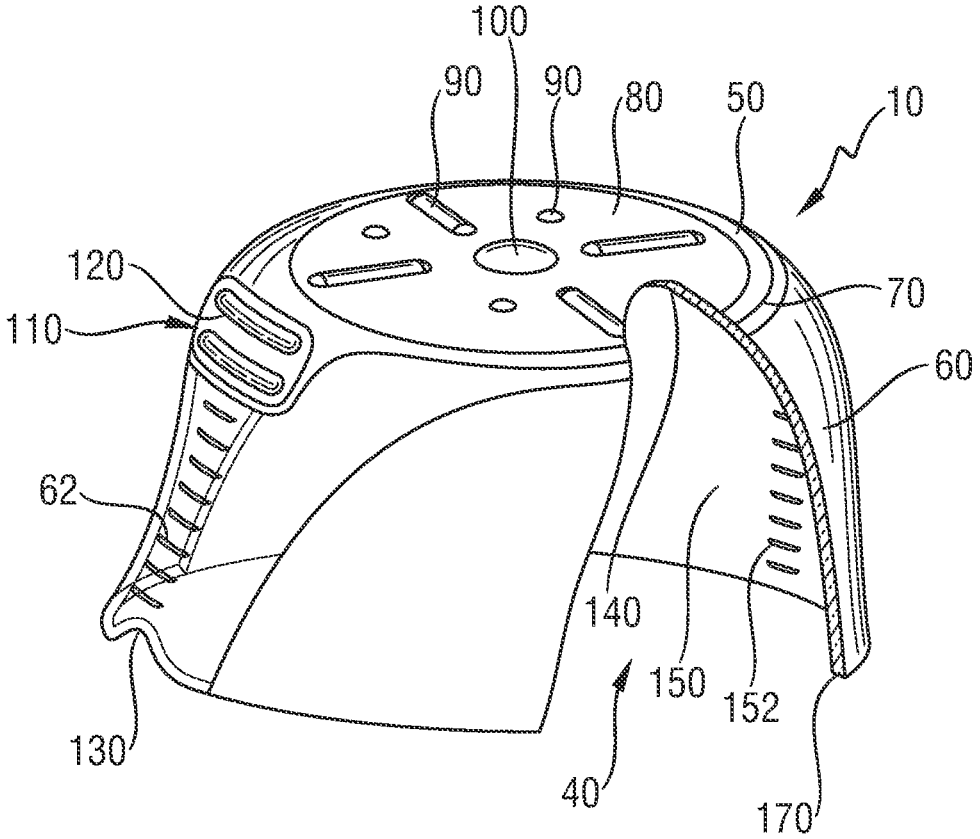
FIG. 3 illustrates an opaque pretreatment cup (10), comprising an opaque scrubbing region (110) and an opaque spreading region (80), with the scrubbing region (110) and spreading region (80) differentiated from the rest of the exterior wall surface (60) by a transparent region which encompasses the front of the pretreatment cup (10), including the spout (130).
Figure 4:
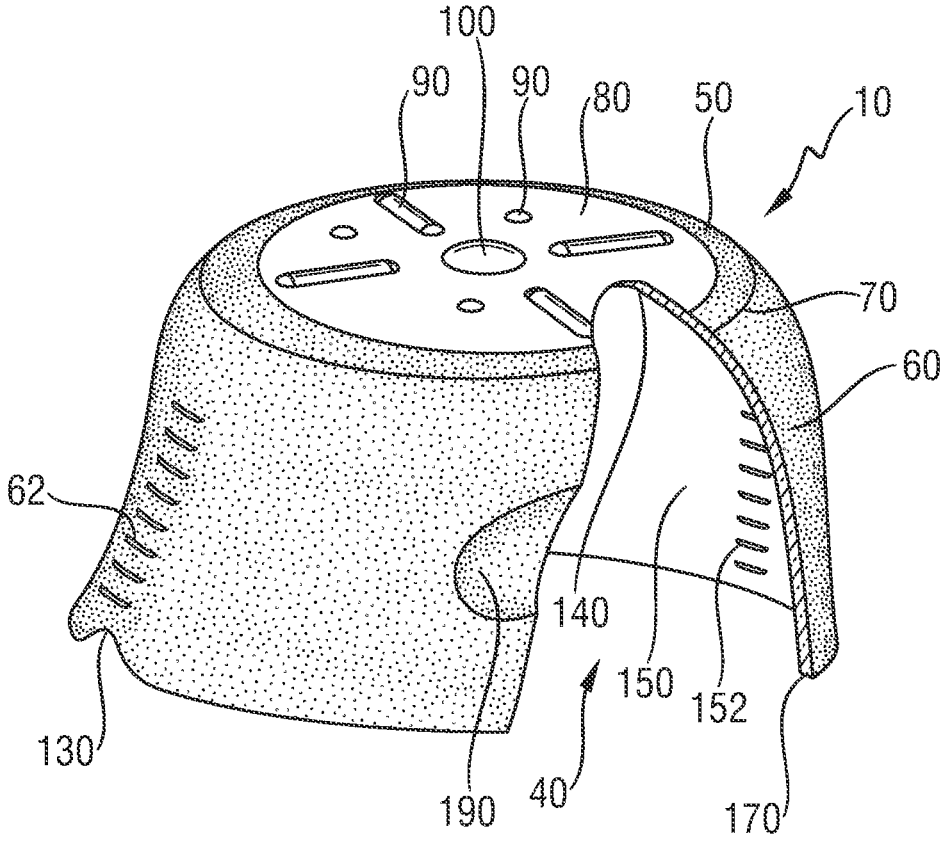
FIG. 4 illustrates an opaque pretreatment cup (10), comprising an opaque spreading region (80), with the spreading region (80) differentiated from the rest of the exterior base surface (50) and exterior wall surface (60) by a difference in surface texture.
Figure 5A:
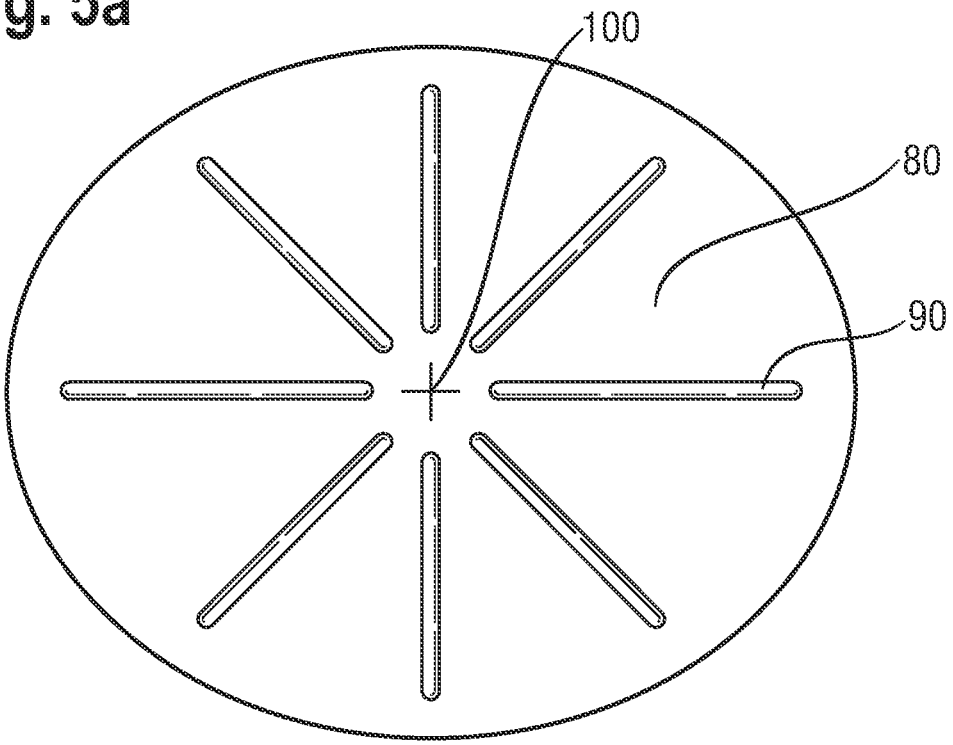
FIG. 5*a* illustrates a top view exemplifying a spreading region (80) comprising spreading protrusions (90) in the form of straight lines, radiating from a central point (100), which is located at the centre of the spreading region (80).
Figure 5B:
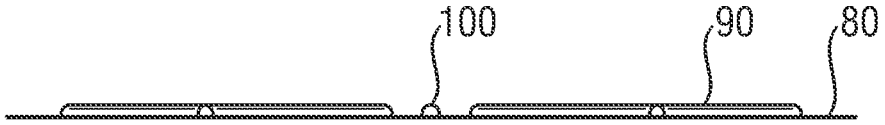
FIG. 5*b* illustrates a side view exemplifying the spreading region (80), of FIG. 3*a*.

It has been discovered that a differentiation of a pretreatment region selected from the group consisting of: a spreading region (80), a scrubbing region (110), and mixtures thereof, from at least part of the remaining outer surface of a pretreatment cup (10), leads to the customer being intuitively guided to correctly use the pretreatment cup (10) for pretreating fabric stains.

When referring to a pretreatment cup, all percentages, ratios and proportions used herein are by weight percent of the pretreatment cup, unless otherwise specified. When referring to a liquid detergent composition, all percentages, ratios and proportions used herein are by weight percent of the liquid detergent composition, unless otherwise specified. The term "dose", unless indicated otherwise, is defined as a measured amount of liquid to be delivered from a container, cup, or other suitable device. Preferably, the dose is measured using the pretreatment cup.

The Pretreatment Cup:

The pretreatment cup (10) comprises a base, an exterior wall, and an opening (40) that is circumscribed by a rim (170). The opening (40) is at least partially opposite the base. The outer surface of the pretreatment cup is made up of an exterior base surface (50) connected to an exterior wall surface (60) at an exterior periphery (70). The pretreatment cup (10) may also comprise an interior base surface (140) and an interior wall surface (150), preferably at least partially connected together at an interior periphery. The pretreatment cup (10) also comprises a pretreatment region selected from the group consisting of: a spreading region (80), a scrubbing region (110), and mixtures thereof. Such a pretreatment cup is exemplified in FIGS. 1 to 4, and FIGS. 7 and 9.

The pretreatment cup (10) can be any suitable size. For stability, the base will typically have an area of from 300 $mm^2$ to 8,000 $mm^2$, preferably from 900 $mm^2$ to 5,600 $mm^2$, most preferably from 1,900 $mm^2$ to 3,800 $mm^2$. As such, the width of the base will typically range from 20 mm to 100 mm, preferably 35 mm to 85 mm, most preferably from 50 mm to 70 mm. For easy filling, the opening (40) will typically have an area of from 700 $mm^2$ to 9,500 $mm^2$, preferably from 1,500 $mm^2$ to 7,000 $mm^2$, most preferably from 2,500 $mm^2$ to 5,000 $mm^2$. As such, the width of the opening (40) will typically range from 30 mm to 110 mm, preferably 45 mm to 95 mm, most preferably from 60 mm to 80 mm. The wall will typically have a height from 20 mm to 85 mm, preferably from 35 mm to 70 mm.

The exterior base surface (50) can be connected to the exterior wall surface (60) at the exterior periphery (70) at any angle, including 90°. Additionally, the exterior periphery (70) preferably comprises a curvature from the exterior base surface (50) to the exterior wall surface (60). Preferably, the radius of curvature at the exterior periphery (70) is from 2 mm to 35 mm, more preferably from 3.5 mm to 25 mm, most preferably from 5 mm to 15 mm. A curvature is particularly preferred if the pretreatment cup (10) comprises a scrubbing region (110) that is at least partially located at the exterior periphery (70).

The base, the wall, or both the base and the wall of the pretreatment cup (10) can be a single layer of material, such as high density polyethylene or polypropylene, a multilayered material, or any other material having sufficient structural integrity to be used as a pretreatment cup (10), and preferably also as a dosing device for dosing the liquid detergent composition into a washing machine. Preferably, the base, the wall, or both the base and the wall of the pretreatment cup (10) comprise polypropylene, for improved resistance to wear during pretreating and during wash cycles.

The exterior base surface (50) can provide a surface arrangement that can be stably set upon another surface that is substantially flat as measured on a scale of centimeters, such as a table or a flat portion of a washing machine or dryer. In a preferred embodiment, the exterior base surface (50) can be essentially flat, or have a slight curvature, such that the cup (10) can be stably placed on a flat surface. With such a configuration, when liquid detergent composition is poured into the pretreatment cup (10), the cup (10) will not easily tip over as detergent composition is poured into the pretreatment cup (10).

The pretreatment cup (10) can be provided with one or more indicia. The indicia are preferably located on a surface selected from the group consisting of: the interior wall surface (150), the exterior wall surface (60), and mixtures thereof. Preferably, the interior wall surface (150) is provided with one or more interior indicia (152). It is particularly preferred that the exterior wall surface (60) is provided with one or more exterior indicia (62), when at least part of the wall is translucent or transparent. To facilitate easier measuring, both the interior wall surface (150) and exterior wall surface (60) can be provided with indicia. The indicia can be an etch, a depression, a raised portion, printing, or any other structure that is observable by the user.

The indicia can indicate the recommended dosage of liquid detergent composition to be poured into the pretreatment cup. Preferably, the indicia indicate the recommended dosages for a usage selected from the group consisting of: stain pretreating, average duty wash conditions, light duty wash conditions, heavy duty wash conditions, and mixtures thereof. Light duty wash conditions, typically consist of lightly soiled loads and low water hardness (from 50 mg/l to 125 mg/l of $CaCO_3$). Average duty wash conditions typically consist of moderately soiled loads and average water hardness (from 126 mg/l to 250 mg/l of $CaCO_3$). Heavy duty wash conditions typically consist of heavily soiled loads and high water hardness (greater than 250 mg/l of $CaCO_3$).

The pretreatment cup can also comprise a means for attachment to a liquid detergent composition container, preferably to the container cup. Suitable means include a clip, a screw thread, or a push-fit mechanism. In one embodiment, the interior base surface (140) of the pretreatment cup (10) comprises the first part of an attachment system, and the cup exterior top surface (310) of a cup (300), comprises a second part of an attachment system, wherein said attachment system comprises a cooperating attachment protrusion (200) and attachment channel (320). Alternatively, the pretreatment cup may also engage with a bottle to form a seal to close the container, hence forming a cup for the container.

The pretreatment cup may also comprise a spout (130), located on the rim (170). Preferably, the spout (130) is located vertically in line with the scrubbing region (110), if present, to make it easier to pour a small amount of liquid detergent composition onto a stain, spread the composition with the spreading region (80) and scrub with the scrubbing region (110) without the customer having to change his grip. Suitable spouts (130) include an outcrop from the rim (170) and wall, or may optionally comprise a hole in the wall, preferably close to the opening. In a preferred embodiment, the pretreatment cup (10) includes a baffle (180), adjacent to the spout (130). Such baffles (180) split the opening (40) into two or more sections comprising a fill opening (42) and a spout opening (44). The baffle (180) helps the customer to meter the required dose of liquid detergent composition onto the stain, without spilling excess liquid detergent composition.

The exterior wall surface (60) of the pretreatment cup (10) may also comprise a gripping region (190). The gripping region (190) may be selected from: an indented region, a raised region, a textured region, or a combination thereof. The gripping region (190) guides the customer to hold the pretreatment cup (10) is such a manner, that pouring the liquid detergent composition, spreading the liquid detergent composition, scrubbing with the liquid detergent composition, and mixtures thereof, become intuitive for the customer.

Differentiation of the Pretreating Regions:

It has been surprisingly discovered that emphasizing the pretreatment benefits of the pretreatment cup (10) encourages the customer to use the pretreatment cup (10) for pretreating fabric stains. Therefore, a pretreating region selected from: a spreading region (80), a scrubbing region (120), and mixtures thereof, is differentiated from at least part of the remaining combined area of the exterior base surface (50) and the exterior wall surface (60) by a difference in: material, colour, translucency, surface texture, a line, and mixtures thereof. Preferably, the pretreating region is differentiated from at least part of the remaining combined area of the exterior base surface (50) and the exterior wall surface (60) by a difference in: material, colour, translucency, a line, and mixtures thereof. More preferably, the pretreating region is differentiated from at least part of the remaining combined area of the exterior base surface (50) and the exterior wall surface (60) by a difference in: colour, translucency, and mixtures thereof.

For greater emphasis, the pretreating region can be differentiated from at least part of the remaining combined area of the exterior base surface (50) and the exterior wall surface (60) by at least two differences selected from differences in: material, colour, translucency, surface texture, a line, and mixtures thereof.

Preferably, the pretreating region is differentiated from at least 25%, preferably 50%, more preferably 75% of the remaining combined area of the exterior base surface (50) and the exterior wall surface (70).

It is believed that such differentiation helps to guide the customer to intuitively select the correct surface for use in pretreating. Surprisingly, the effect is greater when at least part of the pretreatment cup is opaque. In particular, when at least part of a pretreating region selected from the group consisting of: a spreading region (80), a scrubbing region (110), and mixtures thereof, is opaque, more preferably when all of the pretreating region is opaque. A material is defined as "opaque" when the material has a measured translucency of less than 30%, preferably less than 20%, more preferably less than 10% (using the method enclosed herein for measuring transparency/translucency). A material is defined as "transparent" when the material has a measured translucency of greater than 50%, preferably greater than 60%, more preferably greater than 70%, most preferably greater than 80%.

For similar reasons, if both a spreading region (80) and a scrubbing region (110) are present, the spreading region (80) can be differentiated from the scrubbing region (110) by: a difference in material, a difference in colour, a difference in translucency, a difference in surface texture, a line, and mixtures thereof. The scrubbing protrusions (120) of the scrubbing region (110) typically also have a different pattern from that of the spreading protrusions (90) of the spreading region (80). The scrubbing protrusions (120) are preferably oriented differently from the spreading protrusions (90), or are a different shape, or have both a different orientation and a different shape. It is also believed that such a pretreatment cup leads to an increased perception by the customer that the liquid detergent composition and the pretreatment cup are effective together for pretreating stains, even hydrophobic stains such as grease. While the scrubbing protrusions (120) and the spreading protrusions (90) are preferably made from the same material, they can be also be made from different materials, for example, having different hardness. In such embodiments, the scrubbing protrusions (120) can be made from a more deformable material that can deform over the fabric during pretreating. Such deformable materials are gentler on the fabric during scrubbing. Suitable materials include: thermoplastic elastomers, rubbers, and mixtures thereof. Thermoplastic elastomers are preferred.

Spreading Region:

The pretreatment cup may comprise a spreading region (80) located on a surface selected from the group consisting of: the exterior base surface (50), the exterior wall surface (60), and mixtures thereof. For ease of handling, the spreading region (80) is preferably at least partially located on the exterior base surface (50). Preferably, the spreading region (80) is located on the exterior base surface (50). The spreading region may be any suitable shape, though circular and oval shapes are preferred. While the spreading region may be flat, with the exception of the spreading protrusions (90), a small curvature is preferred for spreading the liquid detergent composition over the stained part of the fabric. In addition, a small curvature helps to smooth out the fabric and remove folds during pretreating. However, it is preferable that the curvature is not so great that the spreading region behaves partially like a wiper, such that the curvature wipes the liquid laundry detergent composition thinly or unevenly over the stain. Preferably, the spreading region (80) has a curvature such that when the pretreatment cup is positioned with the centre of mass of the spreading region (80) on a flat non-deformable surface (such as a table), the pretreatment cup can be tilted a maximum of 45°, preferably a maximum of 30°, more preferably a maximum of 15° before the spreading region is no longer in contact with the non-deformable surface. Preferably, the spreading region (80) has no sharp changes in curvature (such as a step). The centre of mass of the spreading region is calculated using the formula:

$$R = \frac{\int \rho(r) r dV}{\int \rho(r) dV} \tag{1}$$

Figure 6:
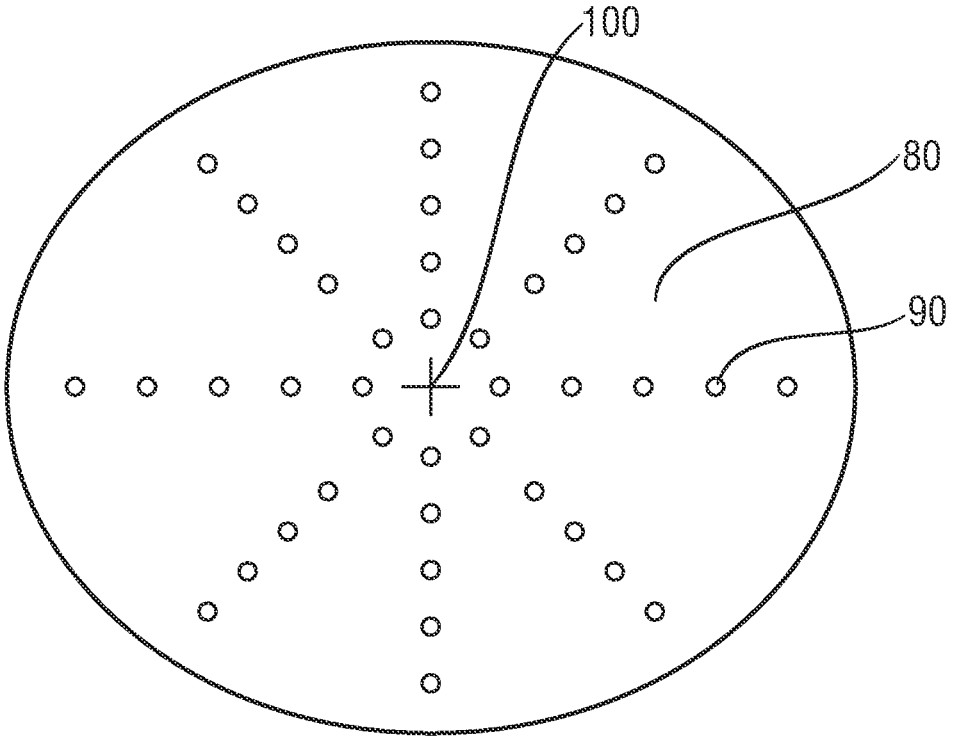
FIG. 6 illustrates a top view exemplifying a spreading region (80) comprising spreading protrusions (90) in the form of dots, radiating from a central point (100), which is located at the centre of the spreading region (80).
Figure 7:
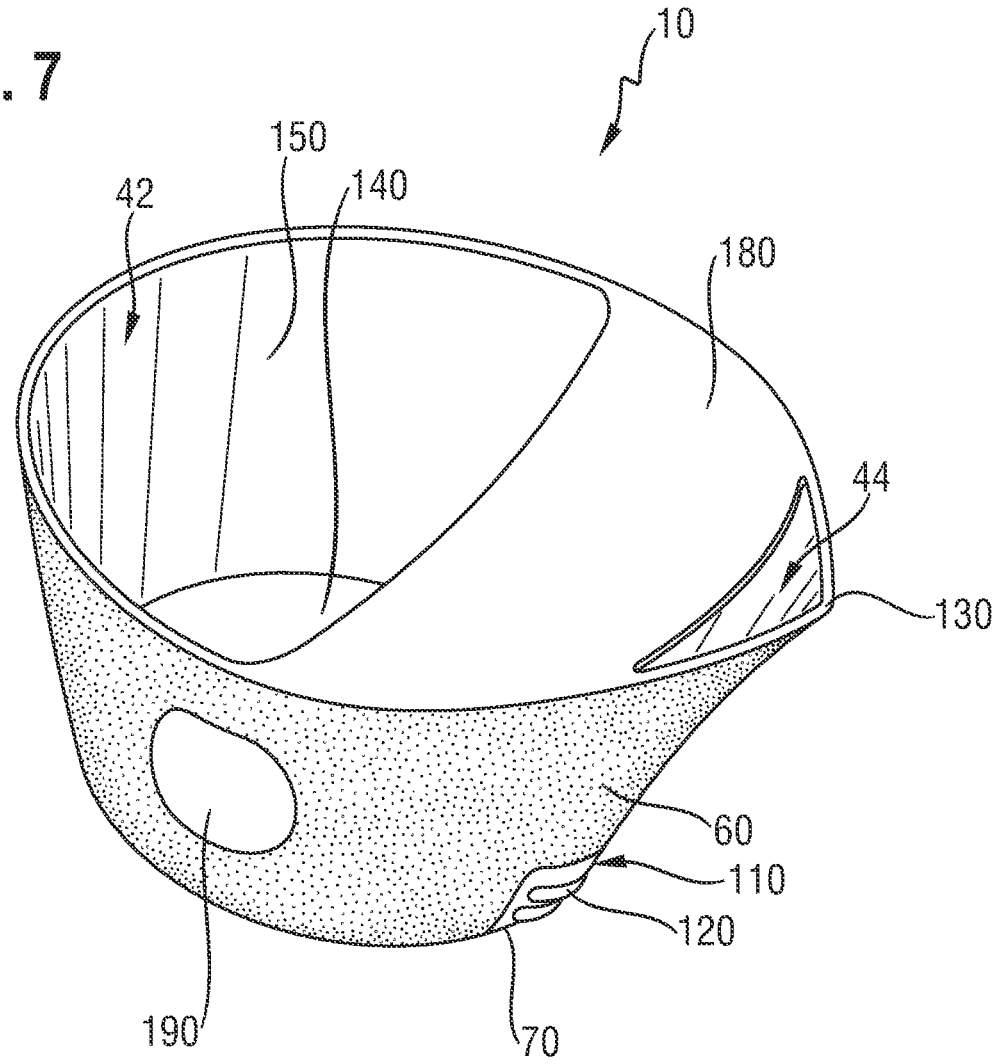
FIG. 7 illustrates an opaque pretreatment cup (10), comprising an opaque scrubbing region (110), with the scrubbing region (110) differentiated from the rest of the exterior base surface (50) and exterior wall surface (60) by a difference in surface texture, further comprising a baffle (180) which divides the opening into a fill opening (42) and a spout opening (44).
Figure 8:
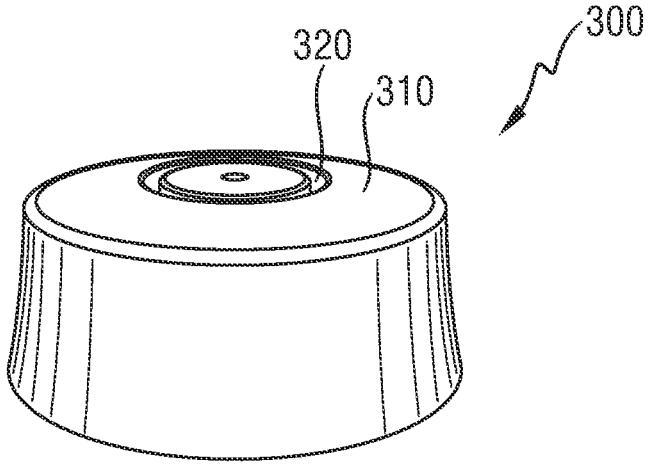
FIG. 8 illustrates a container cup (300) comprising a circular attachment channel (320) on the cup exterior top surface (310).
Figure 9:
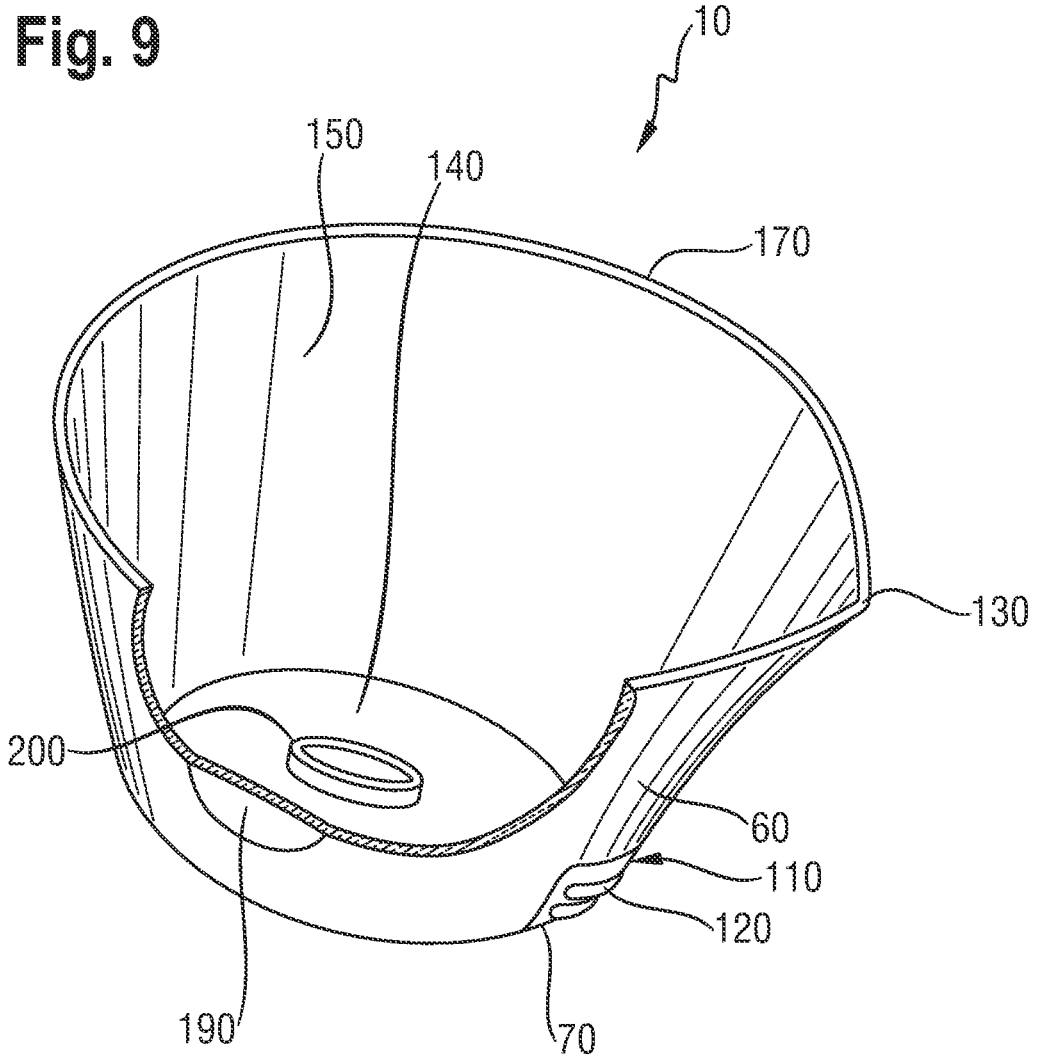
FIG. 9 illustrates an opaque pretreatment cup (10), comprising an opaque scrubbing region (110), with the scrubbing region (110) differentiated from the rest of the exterior base surface (50) and exterior wall surface (60) by a line having a different colour, further comprising a ring-shaped attachment protrusion (200).

The spreading region (80), if present, comprises 1 or more spreading protrusions (90). Preferably, the spreading region (80) comprises at least 2, more preferably at least 5 spreading protrusions (90). The spreading region (80) can comprise any number of spreading protrusions (90), though less than 50, preferably less than 40, more preferably less than 30 are preferred. The spreading protrusions (90) are preferably selected from the group consisting: of lines, dots, and mixtures thereof. If lines are present, they can be straight or curved. They can be from 2 mm to 40 mm, preferably from 3 mm to 25 mm, more preferably from 4 mm to 15 mm in length. The width of the lines can be from 0.2 mm to 4 mm, preferably from 0.5 mm to 3 mm, more preferably from 0.8 mm to 2 mm in width. The lengths are measured along the backbone of the line. Preferably, the lines do not connect to form a closed region. If dots are present, they can be any shape, but are preferably circular or oval in shape. The dots can have a width of from 0.2 mm to 5 mm, preferably from 0.5 mm to 4 mm, more preferably from 1 mm to 3 mm. Such spreading protrusions (90) do not result in the liquid laundry detergent composition being restricted under the spreading region, when the pretreatment cup is used for spreading the liquid detergent composition over a stain. Suitable lines are exemplified in FIGS. 3, 5, 6, and 7. Suitable dots are exemplified in FIGS. 4, 6, and 7.

The spreading protrusions (90) are preferably arranged in a pattern selected from the group consisting of: radial, concentric, spiral, or mixtures thereof. A radial pattern is most preferred. While the central point (100) of the pattern is preferably located at the centre of mass of the spreading region (80), the central point (100) of the pattern can be located at any suitable point on the spreading region (80). The resultant distribution of spreading protrusions (90) helps to gently distribute the liquid detergent composition uniformly over the stain.

For ease of manufacture, the spreading region, preferably including the spreading protrusions (90), can be made from one material. Preferably, the material comprises polypropylene. More preferably, the spreading region is made from polypropylene. However, in other embodiments, the spreading protrusions (90) can be made from a different material from the rest of the spreading region (80).

If the spreading protrusions (90) are too flexible, flicking of the liquid detergent composition may occur during use. Therefore, the spreading protrusions (90) preferably are made from a material having a hardness, as measured on the Rockwell scale (ISO 2039-2), of from 50 to 150. The spreading protrusions (90) are made from a material having a hardness that is more preferably from 60 to 100, and most preferably from 65 to 85. For a similar reason, it is preferred that the spreading protrusions (90) have a height from the exterior base surface (50) of from 0.2 mm to 4 mm, preferably from 0.5 mm to 1.5 mm In addition, such patterns gently smooth out and deform the fibrous structure of the fabric being treated, and help spread the liquid detergent composition uniformly over the stain.

Scrubbing Region:

The pretreatment cup (10) may also comprise a scrubbing region (110), wherein the scrubbing region (110) comprises scrubbing protrusions (120). The scrubbing protrusions (120) preferably have a height of from 0.2 mm to 4 mm, more preferably from 0.5 mm to 1.5 mm. Having both a spreading region and a scrubbing region encourages more customers to pretreat using a liquid detergent composition.

To avoid the scrubbing region (110) affecting spreading of the liquid detergent composition by the spreading region (80), the scrubbing region (110) is preferably located on a different plane to the spreading region (80). In a preferred embodiment, the scrubbing region (110) may be located on the exterior wall surface (60), while the spreading region (80) is located on the exterior base surface (50). In another embodiment, both the spreading region (80) and the scrubbing region (110) are located on the exterior base surface (50), with the exterior base surface (50) curved such that the scrubbing region (110) is located on a different plane to the spreading region (80). In yet another embodiment, the exterior base surface (50) is divided into two connected surfaces which are angled relative to each other, with the scrubbing region (110) located onto one surface, and the spreading region (80) located onto the other surface, such that the two regions are located on different planes.

The scrubbing region (80) is preferably at least partially located on the exterior periphery (70), since many customers prefer to use the exterior periphery (70) to apply greater pressure while scrubbing.

To simplify use, and for easy of manufacture, the spreading region (80) and scrubbing region (110) may be connected together. In a preferred embodiment, the spreading region (80) and scrubbing region (110) may contact each other at the exterior periphery (70).

For ease of manufacture the scrubbing protrusions (120) are preferably made from the same material as the spreading protrusions (90). Even more preferred, the entirety of the scrubbing region (110) and the spreading region (80), preferably including the scrubbing protrusions (120) and the spreading protrusions (90), are made from the same material.

Preferred scrubbing protrusions (120) include: lines, dots, and mixtures thereof. Preferably, the scrubbing protrusions (120) have a pattern with a parallel orientation. Preferably, the pattern is selected from the group consisting of: one or more lines, one or more curves, and mixtures thereof.

In other embodiments, a spreading region (80) is present and no scrubbing region (110) is present. Such embodiments are particularly suited for delicate fabrics such as silk, satin, and rayon, where vigorous scrubbing may damage the fibres or the fabric weave.

Methods:

A) Transparency/Translucency Measurements:

The translucency of a material is measured using the following procedure, using an X-Rite SP-64 Spectrophotometer:

1) Cut out a piece of a relatively flat portion of the bottle. The piece must be able to fit into the base calibration portion (also known as the 'shoe' of the X-Rite SP-64 Spectrophotometer. Clean the sample with a lint free cloth, taking care not to scratch the surfaces.
2) Calibrate the X-Rite SP-64 Spectrophotometer, using the "White reference" and "Black reference", following the procedure in the manual.
3) Select the "Opacity" option from the menu of the X-Rite SP-64 Spectrophotometer, and measure the opacity of the sample, using the "8 mm" aperture size: following the relevant procedure in the instruction manual, take a reading over the Black spot on the shoe, and then a reading over the White spot on the shoe. Repeat the measurement twice, and average the three readings to give the "% opacity".
4) The % translucency is calculated as: 100−% opacity.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A pretreatment cup (10) comprising:

a base comprising an exterior base surface (50);

a wall comprising an exterior wall surface (60); and an opening (40) circumscribed by a rim (170), wherein the opening is at least partially opposite the base;

wherein:

the exterior base surface (50) is connected to the exterior wall surface (60) at an exterior periphery (70);

a surface selected from the group consisting of: the exterior base surface (50), the exterior wall surface (60), and mixtures thereof, comprises a pretreating region;

the pretreating region comprises a spreading region (80), the spreading region (80) comprising spreading protrusions (90), wherein the spreading protrusions (90) are selected from the group consisting: of lines, dots, and mixtures thereof; and the spreading region (80) has a curvature and a center of mass, such that when the pretreatment cup is positioned with the centre of mass of the spreading region (80) on a non-deformable surface, the pretreatment cup can be tilted a maximum of about 45° before the spreading region is no longer in contact with the non-deformable surface; characterized in that:

the pretreating region is differentiated from at least part of the remaining combined area of the exterior base surface (50) and the exterior wall surface (60) by: a difference in material, colour, translucency, surface texture, a line, and mixtures thereof.

2. The pretreatment cup (10) according to claim 1, wherein at least part of the pretreatment cup (10) is opaque.

3. The pretreatment cup (10) according to claim 1, wherein the pretreating region is differentiated from at least about 25% of the remaining combined area of the exterior base surface (50) and the exterior wall surface (60).

4. The pretreatment cup (10) according to claim 3, wherein the pretreating region is differentiated from at least about 50% of the remaining combined area of the exterior base surface (50) and the exterior wall surface (60).

5. The pretreatment cup (10) according to claim 4, wherein the pretreating region is differentiated from at least about 75% of the remaining combined area of the exterior base surface (50) and the exterior wall surface (60).

6. The pretreatment cup (10) according claim 1, wherein the pretreating region is differentiated from at least part of the remaining combined area of the exterior base surface (50) and the exterior wall surface by (60) by at least two differences selected from differences in: material, colour, translucency, surface texture, a line, and mixtures thereof.

7. The pretreatment cup (10) according to claim 1, wherein the spreading protrusions (90) are arranged in a pattern selected from the group consisting of: radial, concentric, spiral, or mixtures thereof.

8. The pretreatment cup according to claim 1, wherein the spreading protrusions (90) have a height from the exterior base surface (50) of from about 0.2 mm to about 4 mm.

9. The pretreatment cup according to claim 1, wherein the spreading protrusions comprise lines having a length of from about 2 mm to about 40 mm.

10. The pretreatment cup according to claim 9, wherein the spreading protrusions comprise lines having a length of from about 4 mm to about 15 mm.

11. The pretreatment cup according to claim 1, wherein the spreading protrusions comprise dots having a width of from about 0.2 mm to about 5 mm.

12. The pretreatment cup according to claim 11, wherein the spreading protrusions comprise dots having a width of from about 1 mm to about 3 mm.

13. The pretreatment cup (10) according to claim 1, wherein the spreading region (80) has a curvature and a center of mass, such that when the pretreatment cup is positioned with centre of mass of the spreading region (80) on a non-deformable surface, the pretreatment cup can be tilted a maximum of about 15° before the spreading region is no longer in contact with the non-deformable surface.

14. The pretreatment cup (10) according to claim 1, wherein the spreading protrusions (90) are made from a material having a hardness, as measured on the Rockwell scale (ISO 2039-2), of from about 50 to about 150.

15. The pretreatment cup (10) according to claim 14, wherein the spreading protrusions (90) are made from a material having a hardness, as measured on the Rockwell scale (ISO 2039-2), of from about 70 to about 110.

16. The pretreatment cup (10) according to claim 1, wherein the spreading region (80) is at least partially located on the exterior base surface (50).

17. The pretreatment cup (10) according to claim 1, wherein the pretreating region comprises a scrubbing region (110), wherein the scrubbing region (110) comprises scrubbing protrusions (120).

18. The pretreatment cup (10) according to claim 17, wherein the scrubbing region (110) is at least partially located at the exterior periphery (70).

* * * * *